US008626020B2

(12) United States Patent
Ikeda

(10) Patent No.: US 8,626,020 B2
(45) Date of Patent: Jan. 7, 2014

(54) IMAGE FORMING APPARATUS

(75) Inventor: Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/232,129

(22) Filed: Sep. 14, 2011

(65) Prior Publication Data

US 2012/0070183 A1 Mar. 22, 2012

(30) Foreign Application Priority Data

Sep. 16, 2010 (JP) ..... 2010-207938

(51) Int. Cl.
*G03G 21/00* (2006.01)
*G03G 15/02* (2006.01)

(52) U.S. Cl.
USPC ..... 399/99; 399/100

(58) Field of Classification Search
USPC ..... 399/99, 100, 171
See application file for complete search history.

(56) References Cited

U.S. PATENT DOCUMENTS

| | | | | |
|---|---|---|---|---|
| 7,212,771 | B2 | 5/2007 | Tanaka et al. | |
| 7,242,887 | B2 | 7/2007 | Takeuchi et al. | |
| 7,254,356 | B2 | 8/2007 | Tomine et al. | |
| 7,366,438 | B2 | 4/2008 | Takeuchi et al. | |
| 7,650,094 | B2 | 1/2010 | Yamamoto et al. | |
| 7,937,011 | B2 | 5/2011 | Yamamoto et al. | |
| 2006/0002740 | A1 | 1/2006 | Tanaka et al. | |
| 2010/0158571 | A1 | 6/2010 | Kidaka et al. | |
| 2012/0230721 | A1 * | 9/2012 | Yamada et al. | 399/100 |

FOREIGN PATENT DOCUMENTS

| | | | |
|---|---|---|---|
| JP | 2005-338797 | A | 12/2005 |
| JP | 2007-72212 | A | 3/2007 |
| JP | 2010-145851 | A | 7/2010 |

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes a cleaning member for cleaning a grid electrode of a corona charger and includes a sheet-like member for opening and closing an opening of the corona charger. The cleaning member is located above the sheet-like member with respect to a direction of gravitation, and wherein the sheet-like member is present right below the cleaning member when the cleaning member is present in an image formation range with respect to a longitudinal direction of the grid electrode.

2 Claims, 9 Drawing Sheets

IMAGE FORMING APPARATUS

FIELD OF THE INVENTION AND RELATED ART

The present invention relates to an image forming apparatus, such as a copying machine, a printer, a facsimile machine, or a multi-function machine having a plurality of functions of these machines.

In the image forming apparatus of an electrophotographic type, an image is conventionally formed through an electrophotographic process including processes of charging, exposure, development and transfer. In the charging process, a photosensitive member is electrically charged uniformly to a potential of a predetermined polarity by a corona charger.

Further, at an opening of a shield of the corona charger, a mesh-like grid electrode is provided so that a surface potential or the photosensitive member is a desired potential. Due to such a shape of the grid electrode, a contaminant such as airborne toner is liable to be deposited at an inner surface (close to a discharging electrode) of the grid electrode. When such a contaminant is deposit at the limes surface of the electrode in a large amount, improper charging occurs at the deposition portion resulting in image density non-uniformity.

The grid electrode is contaminated with the toner, an external additive and dust particles which are scattered in a main assembly of the image forming apparatus and electrostatically or physically deposited on the grid electrode. In a conventional image forming apparatus, the grid electrode on which the contaminant is deposited becomes unstable in control property, so that a distribution of charging in the corona charger cannot be normally maintained. In this state, the photosensitive drum is electrically charged, with the result that an image defect occurs. As a countermeasure thereto, a means for cleaning a matter to be cleaned (contaminant) has been proposed.

In Japanese Laid-Open Patent Application (JP-A) 2005-338797, a cleaning device for cleaning the inner surface of the grid electrode is provided to prevent deposition of the toner on the grid electrode in a large amount. Specifically, the inner surface of the grid electrode is cleaned by reciprocal movement of a cleaning brush while bringing the cleaning brush into contact with the inner surface of the grid electrode.

Further, the corona charger uses corona discharge, so that an electric discharge product such as ozone ($O_3$) or nitrogen oxides ($NO_x$) is generated.

When such an electric discharge product is deposited on the photosensitive member and takes up moisture, a so-called "image deletion (flow)" phenomenon such that a surface resistance at a portion on which the electric discharge product is deposited is lowered, thus failing to faithfully reproduce an electrostatic latent image depending on image information.

JP-A 2007-72212 discloses prevention of deposition of the electric discharge product on the photosensitive member during non-image formation by providing a shutter to the corona charger and by moving the shutter into and away from a gap between the corona charger and the photosensitive member so as to cover an opening of the corona charger.

Similarly, in order to prevent the image flow occurring below the charger in the case where the charger is left standing in a high-temperature and high-humidity environment after continuous use, a sheet-like member (shutter) is sandwiched between the grid electrode and the photosensitive member during non-charging to prevent the image flow below the charger (JP-A 2010-145851).

However, in the case where the corona charger is provided above the photosensitive member with respect to a direction of gravitation and a grid cleaning member and the shutter are operated by the same driving means, a grid electrode deposition matter (contaminant) scraped off by the grid cleaning member is dropped on the photosensitive member in some cases. In these cases, there arises a problem such that the photosensitive drum is rubbed with the contaminant to cause the image flow or incorporation of the contaminant into a developing device to result in improper coating or the like. During cleaning with the grid cleaning member, compared with during cleaning of the discharging electrode of the corona charger, a drop amount of the deposited matter (contaminant) dropped onto the photosensitive member is large and becomes problematic.

SUMMARY OF THE INVENTION

The present invention has been accomplished in order to solve the above-described problems resulting from drop, into a photosensitive member, of a grid electrode deposition matter (contaminant) scraped off by a grid cleaning member.

That is, a principal object of the present invention is to provide an image forming apparatus capable of reducing an occurrence of image flow (deletion) caused by rubbing of the photosensitive member with a contaminant which is scraped off of a grid electrode by a cleaning member and is dropped on the photosensitive member and capable of reducing an occurrence of improper coating of a developer by incorporation of the contaminant into a developing container.

According to an aspect of the present invention, there is provided an image forming apparatus comprising:

a cleaning member for cleaning a grid electrode of a corona charger; and a sheet like member for opening and closing an opening of the corona charger, wherein the cleaning member is located above the sheet-like member with respect to a direction of gravity, and wherein the sheet-like member is present right below the cleaning member when the cleaning member is present in an image formation range with respect to a longitudinal direction of the grid electrode.

These and other objects, features and advantages of the present invention will become more apparent upon a consideration of the following description of the preferred embodiments of the present invention taken in conjunction with the accompanying drawings.

Figure 3:
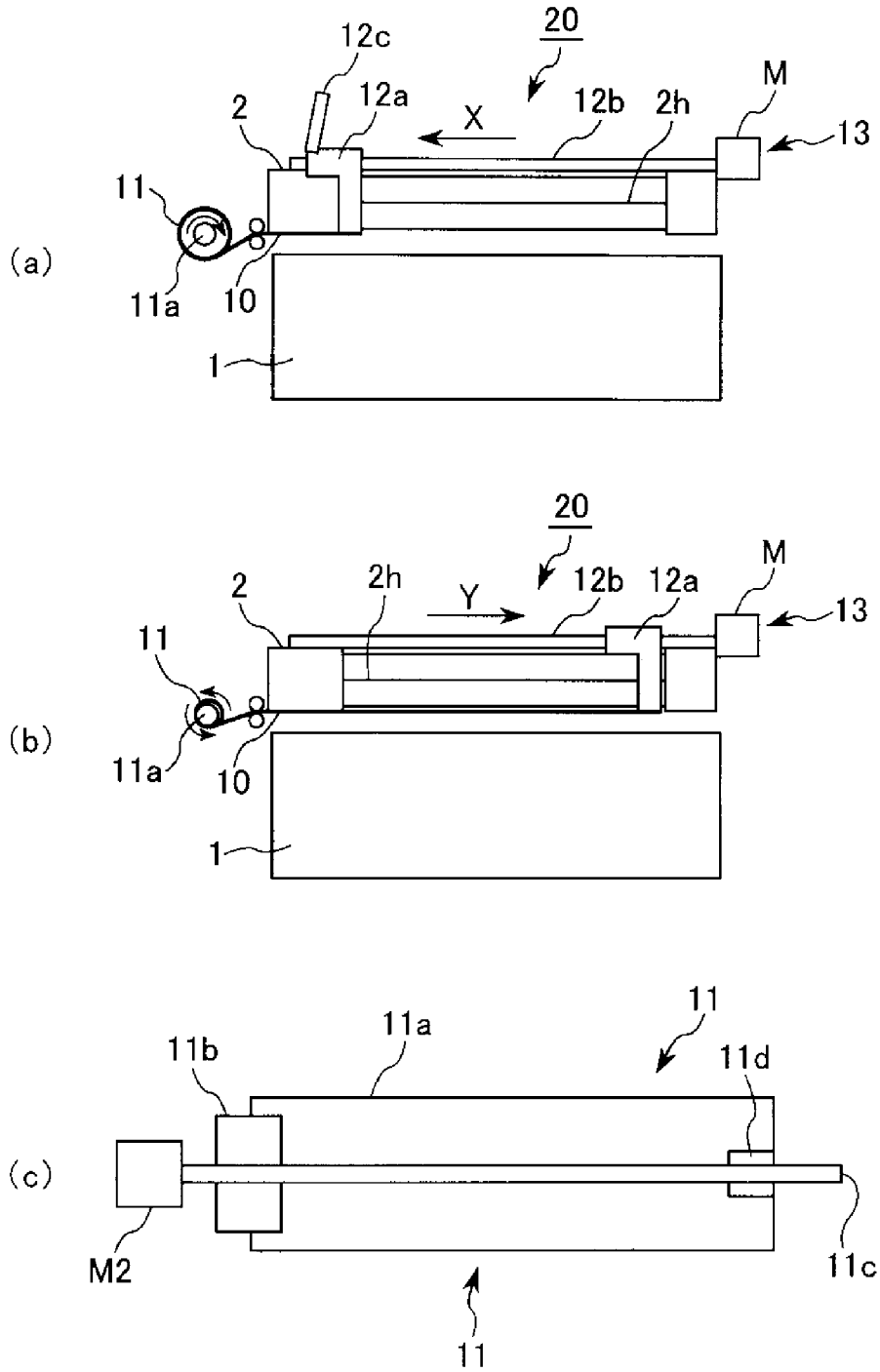

Parts (a) to (c) of FIG. 3 are schematic views for illustrating a winding-up mechanism of a corona charger, wherein (a) if a schematic view showing an open state of the corona charger, (b) is a schematic view showing a closed state of the corona charger, and (c) is a schematic sectional view of a winding-up device.

Figure 4:
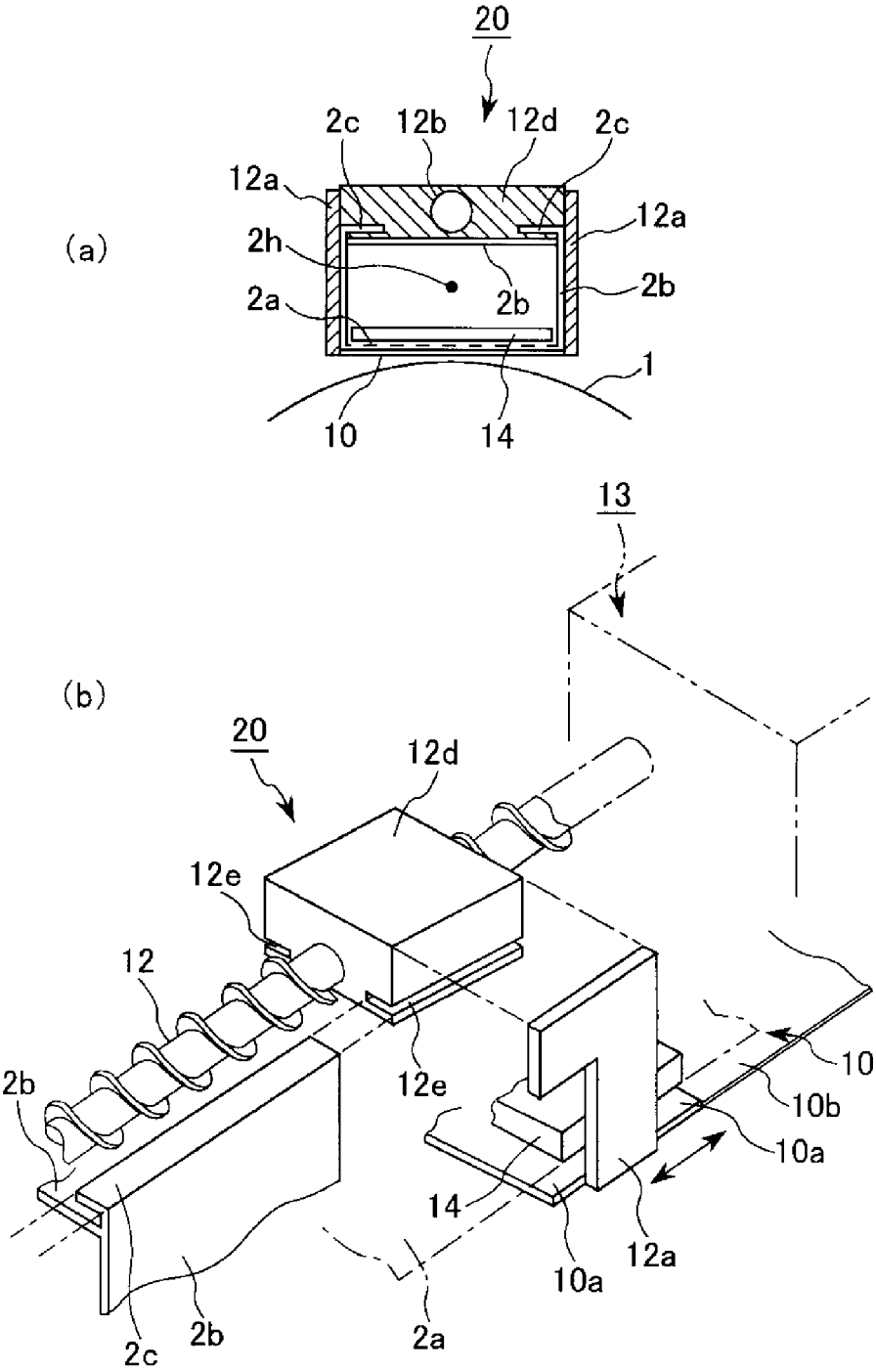

Parts (a) and (b) of FIG. 4 are schematic views showing an opening and closing mechanism, wherein (a) is a schematic sectional view of the opening and closing mechanism, and (b) is a schematic perspective view of the opening and closing mechanism.

Figure 5:
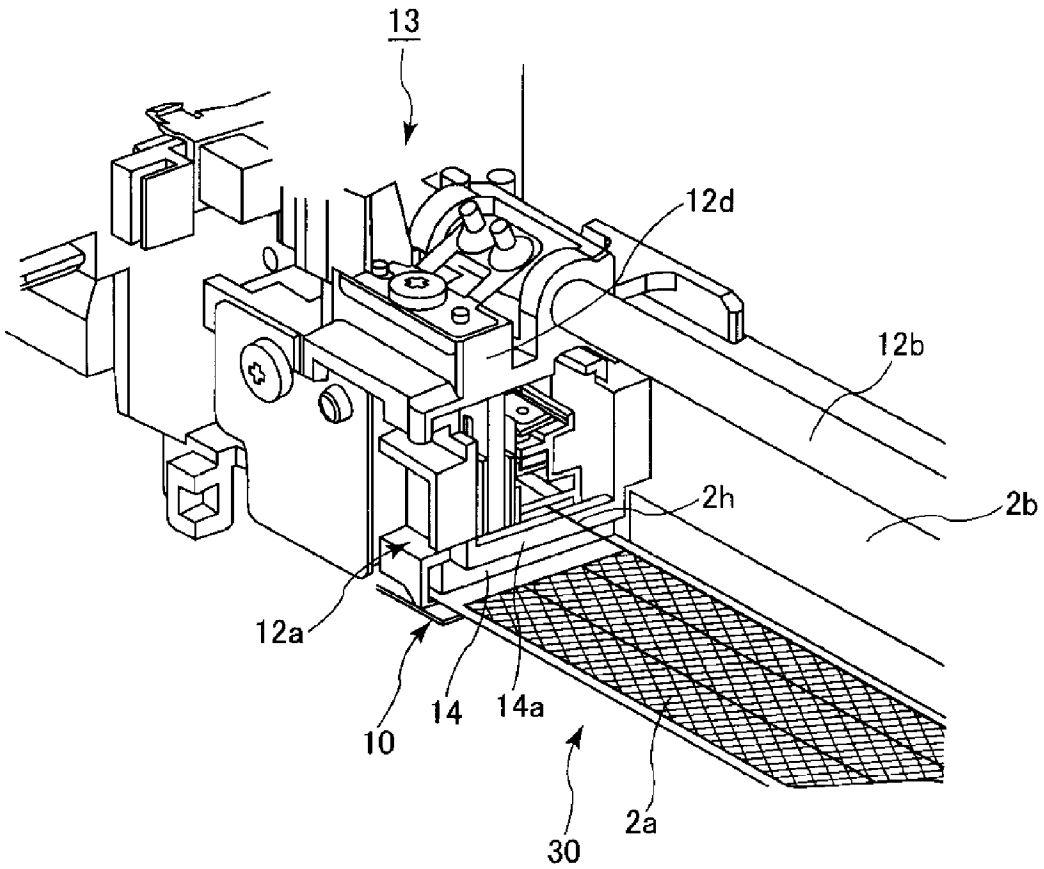

FIG. 5 is a perspective view showing a positional relationship among a driving mechanism, a grid cleaning device and a charger shutter.

Figure 6:
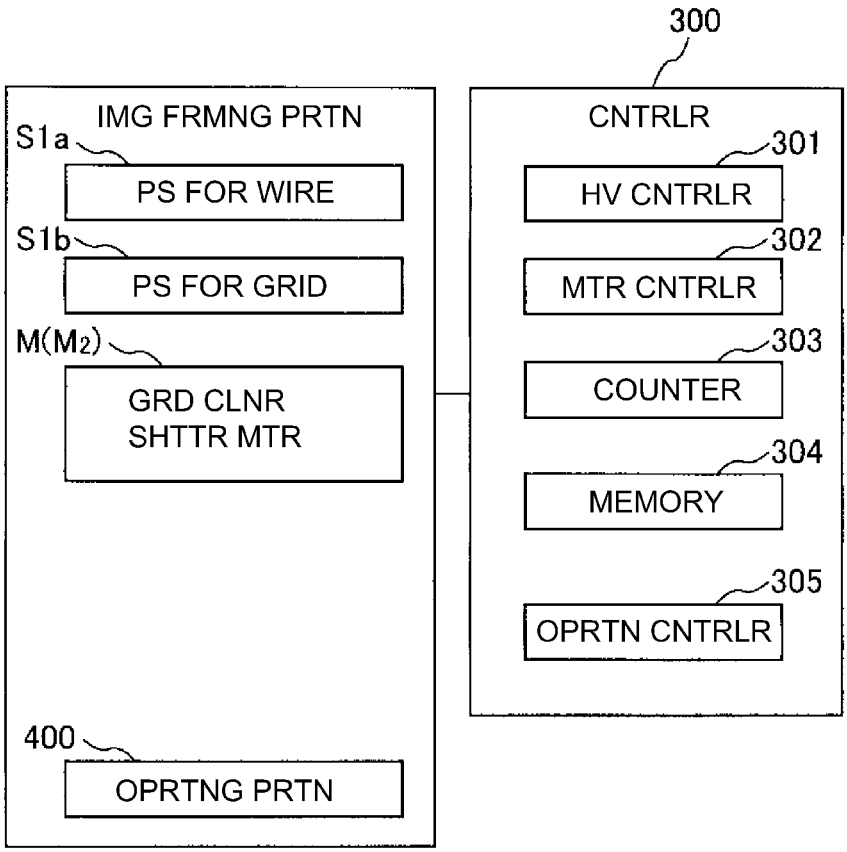

FIG. 6 is a block diagram for illustrating an operation control of the charger shutter and a grid cleaning member.

Figure 7:
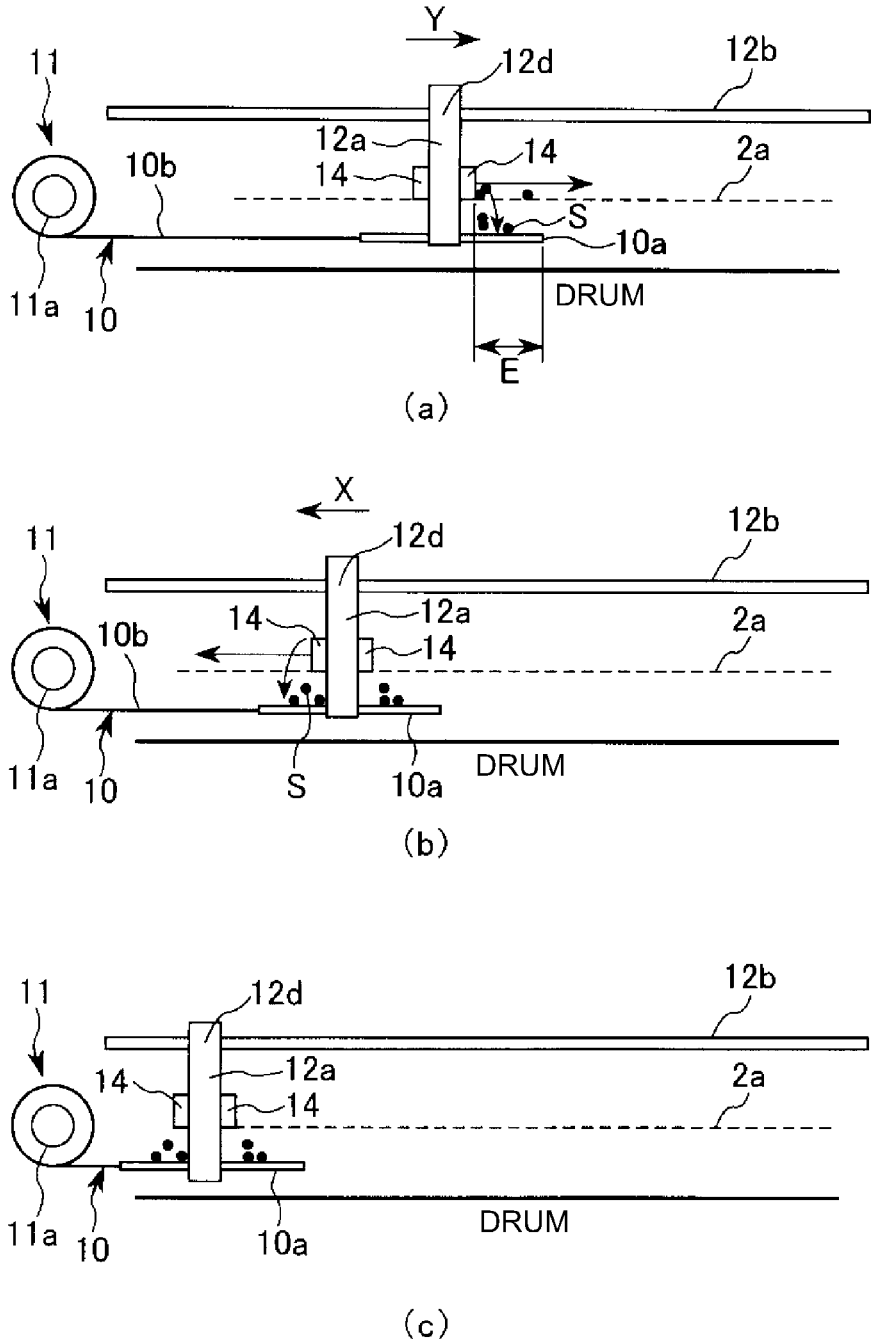

Parts (a) to (c) of FIG. 7 are schematic views for illustrating a positional relationship between the charger shutter and the grid cleaning member and an operating state in Embodiment 1, wherein (a) shows a state in a forward path, (b) shows a state in a backward path, and (c) shows a state during stand-by.

Figure 8:
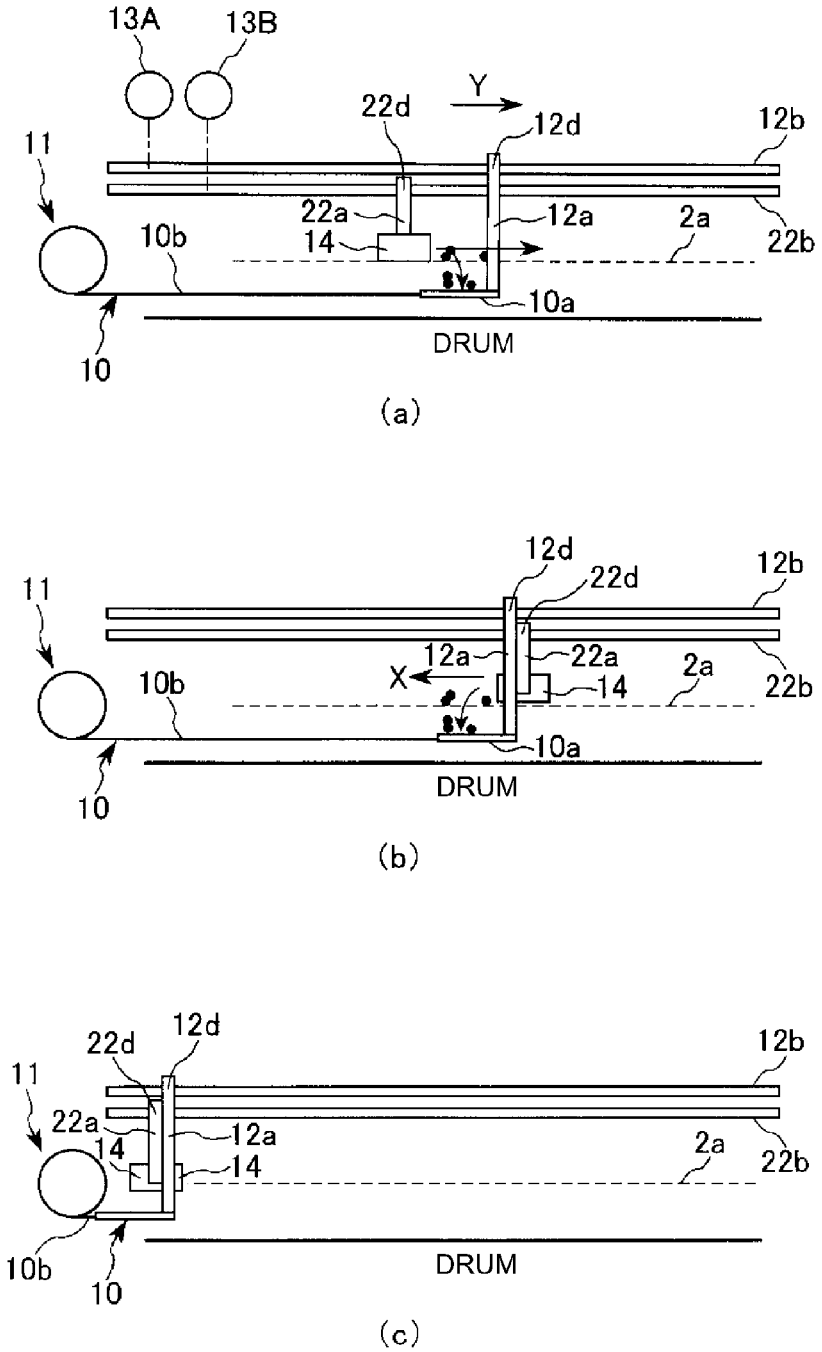

Parts (a) to (c) of FIG. 8 are schematic views for illustrating a positional relationship between the charger shutter and the grid cleaning member and an operating state in Embodiment 2, wherein (a) shows a state in a forward path, (b) shows a state in a backward path, and (c) shows a state during stand-by.

Figure 9:
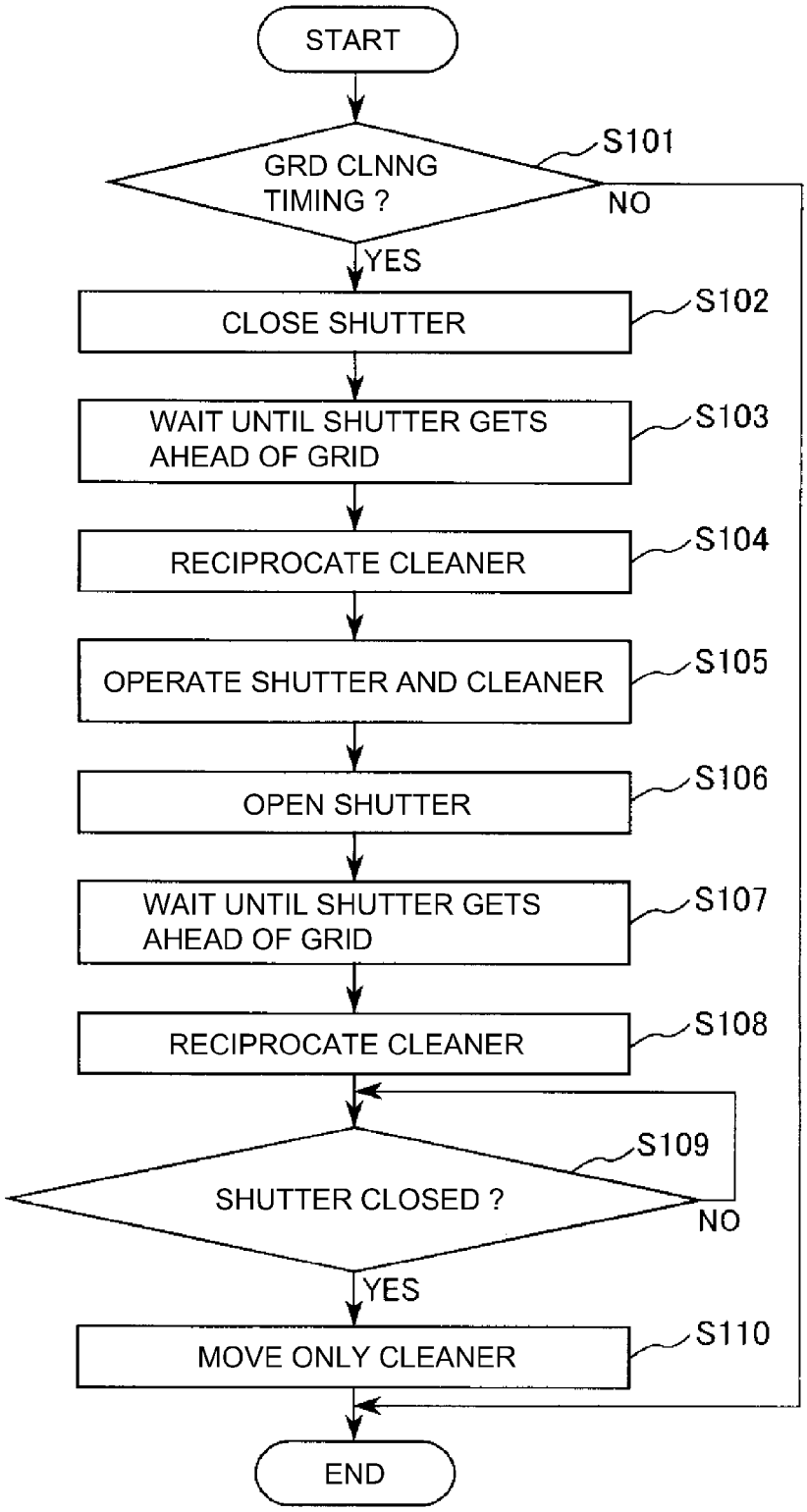

FIG. 9 is a flowchart for illustrating an operation of the charger shutter and the grid cleaning member in Embodiment 2.

DETAILED DESCRIPTION OF THE PREFERRED EMBODIMENTS

Hereinbelow, embodiments according to the present invention will be described with reference to the drawings.

Embodiment 1

First, a general structure of the image forming apparatus will be described with reference to FIG. 1. The image forming apparatus in this embodiment is a laser beam printer of an electrophotographic type.

(General Structure of Image Forming Apparatus)

Figure 1:
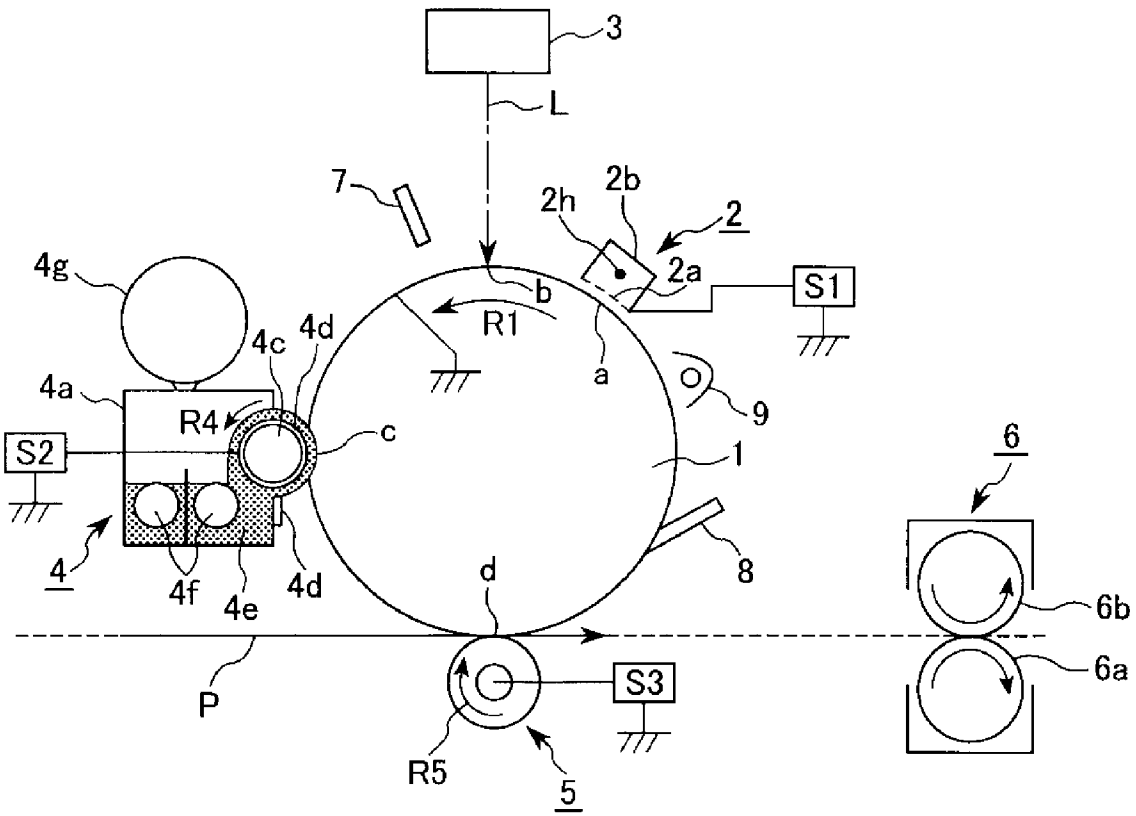
FIG. 1 is a schematic sectional view of an image forming apparatus according to the present invention in Embodiment 1.

As shown in FIG. 1, a drum-like photosensitive member as an image bearing member (hereinafter referred to as a photosensitive drum). A charging device 2, an exposure device 3, a potential measuring device 7, a developing device 4, a transferring device 5, a cleaning device 8, and an optical discharging device 9 and disposed in this order around the photosensitive drum 1 along a rotational direction (indicated by an arrow R1) of the photosensitive drum 1. Further, a fixing device 6 is disposed downstream of the transferring device 5 with respect to a conveying direction of a recording material P.

Next, individual image forming devices associated with image formation will be described specifically.

(Photosensitive Drum)

The photosensitive drum 1 in this embodiment as the image bearing member is a cylindrical (drum-type) electrophotographic photosensitive member as shown in FIG. 1. The photosensitive drum 1 has a diameter of 84 mm and is rotationally driven in the arrow R1 direction about a center shaft (not shown) at a process speed (peripheral speed) of 500 mm/sec.

Figure 2:
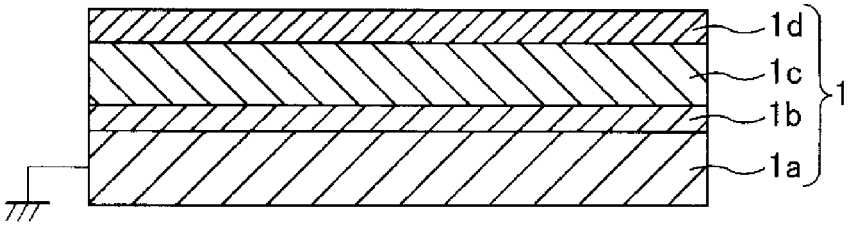
FIG. 2 is a schematic sectional view showing a layer structure of a photosensitive member.

Further, as shown in FIG. 2, the photosensitive drum 1 includes a photosensitive layer of a negatively chargeable organic photoconductor. Specifically, the photosensitive drum 1 includes an aluminum cylinder 1*a* as an electroconductive support at an inner position with respect to a radial direction (a lower portion in FIG. 2). On the cylinder 1*a*, a three-layer structure consisting of an under coat layer 1*b* for suppressing interference of light and improving an adhesiveness with an upper layer, a charge generation layer 1*c*, and a charge transport layer 1*d* is formed. The charge generation layer 1*c* and the charge transport layer 1*d* constitute the photosensitive layer described above.

(Charging Device)

The charging device 2 in this embodiment is, as shown in FIG. 1, a corona charger of a scorotron type. That is, the corona charger 2 includes a discharging wire 2*h* as a discharging electrode, a U-shaped electroconductive shield 2*b* which is provided so as to surround the discharging wire 2*h*, and a grid electrode 2*a* provided at an opening of the shield 2*b*. In this embodiment, the discharging wire 2*h* is a single wire. However, in order to meet high-speed image formation, the corona charger 2 may also include two discharging wires 2*h*. In this case, a partition shield may be provided so as to shield between the two discharging wires 2*h*. These constitutions are well known to those skilled in the art and therefore will be omitted from further description.

In this embodiment, the corona charger 2 is provided along a generatrix direction of the photosensitive drum 1. Therefore, a longitudinal direction of the corona charger 2 is parallel to an axial (shaft) direction of the photosensitive drum 1. Further, in this embodiment, as shown in FIGS. 4 and 5, the grid electrode 2*a* has a planar mesh-like extending in the axial direction of the photosensitive drum 1. However, the shape of the grid electrode 2*a* is not limited thereto.

Further, to the corona charger 2, as shown in FIG. 1, a charging bias application source S1 for applying a charging bias is connected. The corona charger 2 uniformly charges the surface of the photosensitive drum 1 to a potential of a negative polarity at a charging position a by the charging bias applied from the application source S1. Specifically, a DC charging bias (voltage) is applied to the discharging wire 2*h* and the grid electrode 2*a* from power sources S1 (S1*a*, S1*b*) (FIG. 6) controlled by a high-voltage controller 301 of a control device 300 for the main assembly of the image forming apparatus.

(Exposure Device)

The exposure device 3 in this embodiment is a laser beam scanner including a semiconductor laser for irradiating the photosensitive drum 1 charged by the corona charger 2 with laser light L. Specifically, on the basis of an image signal (information) sent from a host computer connected to the image forming apparatus through a network cable, the image exposure device 3 outputs the laser light L. The charged surface of the photosensitive drum 1 is exposed to the laser light L along a main scan direction at an exposure position b. By repeating the exposure along the main scan direction during the rotation of the photosensitive drum 1, of the charged surface of the photosensitive drum 1, a portion irradiated with the laser light L is lowered in potential, so that an electrostatic latent image is formed correspondingly to the image information.

Here, the main scan direction means a direction parallel to the generatrix of the photosensitive drum 1 and a sub-scan direction means a direction parallel to the rotational direction of the photosensitive drum 1.

(Developing Device)

The developing device 4 deposits a developer (toner) on the electrostatic latent image formed on the photosensitive drum 1 by the charging device 2 and the exposure device 3 to visualize the latent image. The developing device 4 in this embodiment employs a two component magnetic brush developing method and also employs a reverse developing method. The developing device 4 includes a developing container 4*a*, a developing sleeve 4*b*, a magnet 4*c*, a developing blade 4*d*, a developer stirring member 4*f*, and a toner hopper 4*g*. Incidentally, a reference symbol 4*e* shown in FIG. 1 represents a two component developer accommodated in the developing container 4*a*. The developing sleeve 4*b* is a non-magnetic cylindrical member and is rotatably provided to the developing container 4*a* while a part of an outer peripheral surface thereof is outwardly exposed. The magnet 4*c* is provided in the developing sleeve 4*b* in a state in which it is non-rotatable and fixed. The developing blade 4*d* regulates a thickness of the two component developer 4*e* coated on the developing sleeve surface. The developer stirring member 4*f* is disposed on a bottom side in the developing container 4*a* and feeds the two component developer 4*e* toward the developing sleeve 4*b* while stirring the developer. The toner hopper 4*g* is a container containing toner to be supplied to the developing container 4*a*. The two component developer 4*e* in the developing container 4*a* is a mixture of the toner and a magnetic carrier and is stirred by the developer stirring member 4*f*. The magnetic carrier has a resistance of about $10^{13}$ ohm·cm and a particle size of 40 μm. The toner is triboelectrically charged to a negative polarity by rubbing with the carrier. The above-described developing sleeve 4*b* is disposed oppositely to the photosensitive drum 1 so as to provide the closest distance of 350 μm from the photosensitive drum 1. A portion at which the photosensitive drum 1 and the developing sleeve 4*b* oppose each other constitutes a developing portion c. The developing sleeve 4*b* is rotationally driven so that a movement direction of its surface is opposite from the movement direction of the photosensitive drum 1 surface at the developing portion c. That is, the developing sleeve 4*b* is rotationally driven in a direction indicated by an arrow R4 with respect to the arrow R1 direction of the photosensitive drum 1. A part of the two component developer 4*e* in the developing container 4*a* is held as a magnetic brush layer at the outer peripheral surface of the developing sleeve 4*b* by a magnetic force of the inner magnet 4*c* and is fed to the developing portion c by the rotation of the developing sleeve 4*b*. The magnetic brush layer is regulated as a predetermined thin layer by the developing blade 4*d*, so that the layer contacts the photosensitive drum 1 at the developing portion c.

To the developing sleeve 4*b*, a developing bias application source S2 is connected, and the toner in the developer carried on the surface of the developing sleeve 4*b* is selectively deposited correspondingly to the electrostatic latent image on the photosensitive drum 1 by an electric field generated by a developing bias applied from the application source S2. As a result, the electrostatic latent image is developed as the toner image. In this embodiment, the toner is deposited at an exposed portion (laser light irradiation portion) on the photosensitive drum 1, so that the electrostatic latent image is reversely developed. At this time, a charge amount of the toner subjected to the development on the photosensitive drum 1 is about −25 μC/g. The developer on the developing sleeve 4*b* having passed through the developing portion c is collected in the developing container 4*a* by subsequent rotation of the developing sleeve 4*b*.

Further, in order to keep the toner content of the two component developer 4*e* in the developing container 4*a* in a substantially constant range, an optical toner content sensor is provided in the developing container 4*a*. The toner in an amount corresponding to the toner content detected by the toner content sensor is supplied from the toner hopper 4*g* to the developing container 4*a*.

(Transfer Device)

The transfer device 5 in this embodiment includes a transfer roller 5 as shown in FIG. 1. The transfer roller 5 is rotated in an arrow R5 direction and is urged against the surface of the photosensitive drum 1 with a predetermined urging force to form a nip therebetween as a transfer portion d. To the transfer portion d, the recording material P (e.g., paper or a transparent film) is sent from a sheet-feeding cassette with predetermined control timing.

The recording material P sent to the transfer d is subjected to transfer of the toner image formed on the photosensitive drum 1 while being nip-conveyed between the photosensitive drum 1 and the transfer roller 5. At this time, to the transfer roller 5, a transfer bias (+2 KV in this embodiment) of an opposite polarity to the normal charge polarity (negative) of the toner is applied from a transfer bias application source S3.

(Fixing Device)

The fixing device 6 in this embodiment includes a fixing roller 6*a* and a pressing roller 6*b* as shown in FIG. 1. The recording material P on which the toner image is transferred by the transfer device 5 is conveyed to the fixing device in which the toner image is heated and pressed between the fixing roller 6*a* and the pressing roller 6*b* to be fixed on the recording material P. The recording material P subjected to the fixing is then discharged outside the image forming apparatus.

(Cleaning Device)

The cleaning device 8 in this embodiment includes, as shown in FIG. 1, the cleaning blade. After the toner image is transferred on the recording material P by the transfer device 5, untransferred toner remaining on the photosensitive drum 1 surface is removed by the cleaning blade.

(Optical Discharging Device)

The optical discharging device 9 in this embodiment includes, as shown in FIG. 1, a discharging exposure lamp. Residual charges remaining on the surface of the photosensitive drum 1 subjected to the cleaning by the cleaning device 8 are removed by light irradiation by the discharging exposure lamp.

A series of the image forming process described above is completed and the image forming apparatus prepares for a subsequent image forming process.

(Charger Shutter)

Then, a charger shutter 10 as a sheet-like member for opening and closing the opening of the corona charger 2 will be described.

Part (a) of FIG. 3 shows a state in which the charger shutter 10 as the sheet-like member is opened by being moved in X direction by a winding-up device 11.

In this embodiment, as shown in (a) of FIG. 3, a sheet-like shutter capable of being wound up in a roll shape by the winding-up device 11 is employed as the charger shutter 10 for opening and closing the opening of the corona charger 2.

As a result, it is possible to prevent passing of the corona discharge product falling from the corona charger 2 onto the photosensitive drum 1. In addition, it is possible to prevent the photosensitive drum 1 from being damaged to cause image defect when the charger shutter 10 contacts the photosensitive drum 1 by some possibility. Therefore, in this embodiment, as the charger shutter 10, a 30 μm-thick sheet-like member formed of polyimide resin is employed.

Further, a constitution in which the charger shutter 10 is retracted (wound up) in a roll shape on one end side with respect to a longitudinal direction (main scan direction) of the corona charger 2 during the image formation is employed in order to reduce a space during the retraction (opening) of the charging shutter 10.

(Charger Shutter Opening and Closing Mechanism)

An opening and closing mechanism (moving mechanism) for the charger shutter 10 will be described. As described above, (a) of FIG. 4 shows an open state of the charger shutter 10 in this embodiment. Part (b) of FIG. 3 shows a closed state of the charger shutter 10, and (c) of FIG. 3 shows a schematic structure of the winding-up device 11. Parts (a) and (b) of FIG. 4 are a sectional view and a perspective view, respectively, of the opening and closing mechanism 20.

This opening and closing mechanism 20 includes, as shown in (a) and (b) of FIG. 3 and (a) and (b) of FIG. 4, a driving motor M as a driving source, a movable member 12, a rotatable member 12*b*, a connecting member 12*d*, and the winding-up device 11 and moves the charger shutter 10 along the longitudinal direction (the main scan direction) of the charger shutter 10 so as to be opened and closed.

In this embodiment, a shutter detecting device 12*c* for detecting completion of an opening operation of the charger shutter 10 is provided. The shutter detecting device 12*c* includes a photointerrupter. When the movable member 12*a* reaches the opening operation completion position, the opening operation completion of the charger shutter 10 is detected by utilizing light-blocking of the photo-interrupter by a movable member 12*a*. That is, at the time when the shutter detecting device 12*c* detects the movable member 12*a*, the rotation of the motor M is stopped.

The charger shutter 10 is connected to the movable member 12*a* at its one end as shown in (a) and (b) of FIG. 3 and (b) of FIG. 4. Further, the movable member 12*a* is integrally formed with the connecting member 12*d* which is drive-connected to the rotatable member 12*b*.

The rotatable member 12*b* is, as shown in (c) of FIG. 4, provided with a spiral groove and is, as shown in (a) and (b) of FIG. 3, connected to the driving motor M. When the rotatable member 12*b* is rotationally driven by the driving motor M, the connecting member 12*d* threadly mounted on the rotatable member 12*b* is moved along the spiral groove in the main scan direction (X direction, Y direction). The connecting member 12*d* includes, as shown in (a) and (b) of FIG. 4, recessed portions 12*e* at its end portions. The recessed portions 12*e* are configured to be engaged with rails 2*c*. As a result, the connecting member 12*d* can be reciprocated in the main scan direction on the rails 2*c* provided on the shield 2*b* by rotationally driving the rotatable member 12.

Therefore, when the rotatable member 12*b* is driven by the driving motor M, via the movable member 12*a* integrally formed with the connecting member 12*d*, a moving force in the opening and closing direction is transmitted to the charger shutter 10.

Further, as shown in (a), (b) and (c) of FIG. 3, the winding-up device 11 as the winding-up means includes a cylindrical winding-up roller (winding-up member) 11*a* for fixing one end of the charger shutter 10 and for winding up the charger shutter 10 at its peripheral portion. Further, the winding-up device 11 includes a shaft member 11*c* to be rotationally driven by the connected to a driving motor M2 at its end. The winding-up device 11 includes a torque limiter 11*b*, fixed to the winding-up roller 11*a*, for transmitting a rotational driving force of the shaft member 11*c* to the winding-up roller 11*a* and sliding the shaft member in the case where a difference in rotational torque between the winding-up roller 11*a* and the shaft member 11*c* is not less than a predetermined value. The other end of the shaft member provided so as to penetrate through the winding-up roller 11*a* is engaged with the winding-up roller 11*a* via a bearing 11*d* so that the shaft member 11*c* can independently rotate without being fixed to the winding-up roller 11*a*.

Therefore, when the charger shutter 10 is opened ((a) of FIG. 3), with movement of the charger shutter 10 in the X direction by the driving motor M, the winding-up device 11 is driven by the driving motor M2 at a speed somewhat faster than the moving speed of the charger shutter 10 in the X direction. As a result, the charger shutter 10 is wound up on an as needed bias without sagging downward. That is, the charger shutter 10 is in a state in which the charger shutter 10 is always urged in the X direction by the torque limiter 11*b* of the winding-up device 11.

On the other hand, when the charger shutter 10 is closed ((b) of FIG. 3), with movement of the charger shutter 10 in the Y direction by the driving motor M, the winding-up device 11 is driven by the driving motor M2 at a speed somewhat slower than the moving speed of the charger shutter 10 in the Y direction. As a result, the charger shutter 10 is pulled out without sagging downward. Incidentally, when the charger shutter 10 is in a completely closed state, an urging force in the X direction by the torque limiter 11*b* of the winding-up device 11 acts on the charger shutter 10. For that reason, the charger shutter 10 does not sag downward and is placed in a state in which a tension to some extent is applied to the charger shutter 10.

Therefore, when the charger shutter 10 is closed, it is possible to retain a state in which the corona product is less liable to be leaked from a gap between the charger shutter 10 and the corona charger 2.

(Grid Cleaning Member)

FIG. 5 shows a grid cleaning device 30 as a cleaning means. The grid cleaning device 30 includes a grid cleaning member 14 slidable on the inner surface of the grid electrode 2*a*, a cleaning member supporting member 14*a* and a driving mechanism 13. In this embodiment, the cleaning member supporting member 14*a* is integrally connected to the movable member 12*a*.

The grid cleaning member 14 removes a contaminant such as the toner or the like deposited on the inner surface of the grid electrode 2*a*. Therefore, the grid cleaning member 14 is provided so as to contact the inner surface of the grid electrode 2*a*. Further, as described later, the grid cleaning member 14 cleans the grid electrode 2*a* while sliding on the inner surface of the grid electrode 2*a* during reciprocation by the driving mechanism 13.

Incidentally, in this embodiment, as the grid connect 14, an acrylic brush which is subjected to flame-retardant treatment and is woven into a base cloth was used. Incidentally, it is also possible to use other members formed of nylon, PVC, PPS and the like. Further, the grid cleaning member 14 is not limited to those of a fiber-planting type but may also be an elastic member such as felt or sponge or a sheet onto which an abrasive such as alumina or silicon carbide. That is, a material for the grid cleaning member 14 is not limited to the above members so long as the resultant grid cleaning member can satisfactory perform the cleaning by sliding (rubbing) with the grid electrode 2*a*.

The cleaning member supporting member 14*a* is used for holding the grid cleaning member 14 at the screw shaft (rotatable member) 12*b* via the movable member 12*a* and the connecting member 12*d*. Therefore, in this embodiment, by rotating the screw shaft 12*b*, the grid cleaning member 14 can be moved along the longitudinal direction of the grid electrode 2*a*.

The driving mechanism 13 includes, as shown in (a) and (b) of FIG. 3, (b) of FIG. 4 and FIG. 5, the above-described screw shaft 12*b* and the driving motor M for rotationally driving the screw shaft 12*b*. Therefore, when the cleaning of the grid electrode 2*a* is effected, the screw shaft 12*b* is rotated by driving the driving motor M. Thus, by rotating the screw shaft 12*b*, the grid cleaning member 14 is moved, along the longitudinal direction of the grid electrode 2*a*, from a waiting (stand-by) position located at one longitudinal end side of the corona charger 2 to a reverse position located at the other longitudinal end side. Then, when the grid cleaning member 14 reaches the reverse position, the rotational direction of the driving motor M is reversed to reversely rotate the screw shaft 12*b*, so that the grid cleaning member 14 is moved, along the longitudinal direction of the grid electrode 2*a*, from the reverse position toward the waiting position. In this embodiment, an operating time of the driving motor M from the time when the movement of the grid cleaning member 14 is started from the waiting position is measured and at the time when the operating time reaches 15 seconds, the rotational direction of the driving motor M is reversed.

Thereafter, when the grid cleaning member 14 reaches the waiting position, the drive of the driving motor M is stopped and a series of the cleaning operations is ended. In this embodiment, as described above, the drive of the driving motor M is stopped by the shutter detecting device 12*c*. Further, as another method, it is also possible to stop the rotation of the driving motor M at the time when the operating time of the driving motor M from the time when the rotational direction of the driving motor M is reversed is measured and reaches 15 seconds. Therefore, in this case, a time required for reciprocal movement of the grid cleaning member 14 is 30 seconds.

Incidentally, a series of drive control operations of the driving motor M is performed by a motor control portion 302 of the control device 300 functioning as an executing means shown in FIG. 6. Further, depending on a contamination state of the grid electrode 2*a*, the reciprocal movement of the grid cleaning member 14 may be repeated plural times.

The cleaning (mode) of the grid electrode 2*a* described above is effected when a main power switch of the image forming apparatus is turned on or effected every predetermined number of times (1000 times in this embodiment) of image formation. The number of times of image formation is counted by a counter 303 of the control device 300 and counted data is stored in a storing portion (ROM) 304. Further, the motor controller 302 of the control device 300 actuates the driving motor M at the time when the counted data by the counter 303 reaches a predetermined value, so that the cleaning of the grid electrode 2*a* is executed. When the cleaning of the grid electrode 2*a* is executed, the counted data stored in the storing portion 304 is reset.

Incidentally, the grid cleaning can also be appropriately carried out in a manual manner. That is, as shown in FIG. 6, when an operator (user) provides an instruction of the grid cleaning by operating an operating portion 400 of the image forming apparatus, the control device 300 can carry out the grid cleaning via an operating portion controller 305.

(Positional Relationship between Charger Shutter and Grid Cleaning Member)

In this embodiment, the charger shutter 10 and the grid cleaning member 14 are integrally connected by the connecting member 12*d*, thus being synchronized to perform the reciprocation.

The charger shutter 10 includes a winding-up portion 10*b* to be wound up by the winding-up roller 11*a* of the winding-up device 11 and a non-winding-up portion 10*a* which is not wound up by the winding-up roller 11*a*.

For ease of understanding on the drawings, the winding-up portion 10*b* and the non-winding-up portion 10*a* are illustrated in an exaggerated manner as separate members. However, in this embodiment, the charger shutter 10 is prepared by using the 30 μm-thick polyimide sheet member as described above, so that the winding-up portion 10*b* and the non-winding-up portion 10*a* are actually formed with the same member.

In this case, the positional relationship between the charger shutter 10 and the cleaning member 14 is, as shown in (a) and (b) of FIG. 4, such that the charger shutter 10 is disposed below the grid cleaning member 14 in a direction of gravitation. Further, as shown in (a), (b) and (c) of FIG. 7, in the case of the forward path (Y direction) ((a) of FIG. 7), an end 10*a* of the charger shutter 10 is protruded from a position corresponding to the grid cleaning member 14 in the movement direction of the grid cleaning member 14 by a length E=2 mm. For that reason, a substance (contaminant) S scraped off by the grid cleaning member 14 drops on the charger shutter 10 at an end portion close to the end 10*a* since the charger shutter 10 is present right below the grid cleaning member 14, with respect to the direction of gravitation, at least in an image formation range. The substance S scraped off by the grid cleaning member 14 is not dropped on the photosensitive drum 1.

Further, in the case of the backward path (X direction) ((b) of FIG. 7), similarly, the substance S scraped off by the grid cleaning member 14 drops on the charger shutter 10*a*.

When the contaminant S scraped off by the grid cleaning member 14 drops on the winding-up portion 10*b* of the charger shutter 10, the contaminant S is moved, when the charger shutter 10 is wound up, to the already-wound-up portion to be opposed to the photosensitive drum 1. Then, in the case where subsequent cleaning is effected, the contaminant S drops on the photosensitive drum 1 to cause the image flow or blocking of the developing device. For that reason, the contaminant S scraped off by the grid cleaning member 14 is dropped on the non-winding-up portion 10*a* of the charger shutter 10.

By the above-described operation, when the grid cleaning member 14 is operated, it became possible to reduce a degree of the occurrence of the image flow due to the rubbing of the photosensitive drum with the contaminant (scraped matter) S dropped on the photosensitive drum and the occurrence of improper coating or the like due to the incorporation of the contaminant S into the developing device.

Incidentally, the contaminant S on the charger shutter 10 is removed by a service person as needed.

Embodiment 2

In Embodiment 1, the grid cleaning member 14 and the charger shutter 10 were integrally operated. In this embodiment, the grid cleaning member 14 and the charger shutter 10 are individually driven. Then, the control was effected so that an operation phase is shifted, with respect to the movement direction, between the grid cleaning member 14 and the charger shutter 10 so as to drop the substance S scraped off by the grid cleaning member 14 at the same position (region) during reciprocation for the cleaning. As a result, the non-winding-up portion 10*a* of the charger shutter 10 which is not wound up is narrowed, so that a size of the corona charger 2 can be reduced.

In this embodiment, as described above, the grid cleaning member 14 and the charger shutter 10 are moved with different relative positions during the reciprocation and therefore they are operated by separate driving sources.

That is, as shown in FIG. 8, the driving mechanism 13 described in Embodiment 1 is provided individually for the grid cleaning member 14 and the charger shutter 10. A screw shaft 12*b* of a first driving mechanism 13A is threadably mounted on the connecting member 12*d*, and the connecting member 12*d* is connected to the movable member 12*a* of the charger shutter 10. Further, a screw shaft 22*b* of a second driving mechanism 13B is threadably mounted on a connecting member 22*d*, and the connecting member 22*d* is connected to a movable member 22*a* of the grid cleaning member 14. Therefore, the charger shutter 10 and the grid cleaning member 14 are separately driven by the first and second driving mechanisms 13A and 13B, respectively.

FIG. 9 shows a operation flowchart in this embodiment. Also with reference to (a), (b) and (c) of FIG. 8, first, the grid cleaning member 14 and the charger shutter 10 are in a stand-by state as shown in (c) of FIG. 8. With timing of grid cleaning (S101), the first driving mechanism 13A starts the reciprocation of the charger shutter 10 in Y direction in advance of the reciprocation of the grid cleaning member 14 (S102).

At the time when the non-winding-up portion 10*a* of the charger shutter 10 gets ahead of the grid cleaning member 14 in the movement direction (Y direction) (S103), the second driving mechanism 13B starts the operation of the grid cleaning member 14 (S104). The charger shutter 10 and the grid cleaning member 14 are synchronized and reciprocated.

The positional relationship between the grid cleaning member 14 and the charger shutter 10 is as shown in (a) of FIG. 8 in the forward operation in the Y direction. The first and second driving mechanisms 13A and 13B move the charger shutter 10 and the grid cleaning member 14 for a predetermined time until the grid cleaning member 14 reaches a position (right side) opposite from the position in the stand-by state (S105). As a result, the contaminant S scraped off by the grid cleaning member 14 is dropped and held on the non-winding-up portion 10*a* of the charger shutter 10.

In this embodiment, each of the first and second driving mechanisms 13A and 13B includes a toque limiter (sliding joint) or the like, and the grid cleaning member 14 and the charger shutter 10 are continuously operated even after they are driven for a predetermined time (20 seconds) to be moved to the right side. However, it is also possible to employ such a constitution that a sensor similar to the above-described shutter detecting device 11*c* is mounted at the position opposite from the position in the stand-by state and based on the detection by the sensor, the drive of the first and second driving mechanisms 13A and 13B is stopped.

Next, in the direction in which the charger shutter 10 is closed, i.e., in the X direction, only the charger shutter 10 is moved by the first driving mechanism 13A (S106). Then, as shown in (b) of FIG. 8, at the time when the non-winding-up portion 10*a* of the charger shutter 10 gets ahead of the grid cleaning member 14 in the X direction (S107), the second driving mechanism 13B starts the backward operation of the grid cleaning member 14 in the X direction (S108). The charger shutter 10 and the grid cleaning member 14 perform the backward operation (X direction) in a synchronized manner.

The positional relationship between the grid cleaning member 14 and the charger shutter 10 is as shown in (b) of FIG. 8 in the backward path. As a result, the contaminant S scraped off by the grid cleaning member 14 is dropped and held on the non-winding-up portion 10*a* of the charger shutter 10.

When the charger shutter 10 reaches a home position as shown in (c) of FIG. 8, the operation of the charger shutter 10 is stopped (S109) and then the grid cleaning member 14 is moved until it reaches the waiting (stand-by) position (S110). Thereafter, the grid cleaning operation is ended.

By the grid cleaning as described above, the contaminant S is prevented from dropping on the photosensitive drum when the grid cleaning member is operated. As a result, it is possible to reduce a degree of the occurrence of the image flow due to the rubbing of the photosensitive drum 1 with the contaminant S dropped on the photosensitive drum 1 or the occurrence of the improper coating due to the incorporation of the contaminant S into the developing device. Further, it becomes possible to narrow the non-winding-up portion of the shutter 10, so that the corona charger and the image forming apparatus can be downsized.

The present invention is applicable to electrophotographic image forming apparatuses of various types, including the photosensitive member and a corresponding charging member, such as a copying machine, a printer and a facsimile machine. As a result, it is possible to form a high-quality color image or the like through uniform charging and it is also possible to provide an inexpensive image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 207938/2010 filed Sep. 16, 2010, which is hereby incorporated by reference.

What is claimed is:

1. A charging apparatus for electrically charging a photosensitive member, comprising:

a discharging electrode;

a casing provided with an opening provided so as to surround said discharging electrode and opposing a region, of the photosensitive member, where the photosensitive member is electrically charged by said charging apparatus;

a grid electrode provided in the opening;

a cleaning member fir cleaning a surface, of said grid electrode, opposing said discharging electrode;

a shutter for opening and closing the opening; and a moving mechanism for moving said cleaning member and said shutter in interrelation with each other along a longitudinal direction of said grid electrode, wherein when said cleaning member is located within a range opposing the region where the photosensitive member is electrically charged with respect to the longitudinal direction of the grid electrode, said moving mechanism more said cleaning member and said shutter so that said shutter is located immediately below said cleaning member with respect to a direction of gravitation.

2. A charging apparatus according to claim 1, wherein said shutter is a sheet-like shutter and includes a winding-up mechanism for winding up said sheet-like shutter, and wherein during cleaning of said grid electrode, said winding-up mechanism does not wind up a portion, of said sheet-like shutter, where a substance dropped from said cleaning member is deposited.

* * * * *